United States Patent [19]

Winant

[11] 4,047,021

[45] Sept. 6, 1977

[54] CASTING CONSTRUCTION

[75] Inventor: Arnold Francis Winant, Beechhurst, N.Y.

[73] Assignee: Gim Metal Products, Carle Place, N.Y.

[21] Appl. No.: 658,444

[22] Filed: Feb. 17, 1976

[51] Int. Cl.[2] ..... F21S 1/06

[52] U.S. Cl. ..... 240/78 E; 240/85 R; 248/342

[58] Field of Search ..... 240/78 B, 78 LF, 78 E, 240/78 LG, 78 R, 76, 77, 153, 150, 85 R, 85 C, 85 B; 248/317, 318, 339, 327, 342, 343, 344, 340, 341

[56] References Cited

U.S. PATENT DOCUMENTS

| | | | |
|---|---|---|---|
| 1,000,452 | 8/1911 | Stoddart | 240/78 E |
| 1,156,454 | 10/1915 | Bayley | 240/78 LH |
| 1,516,111 | 11/1924 | Mathieu | 240/78 LF |
| 1,549,333 | 8/1925 | Robinson | 248/342 |
| 1,625,626 | 4/1927 | Riddle | 240/78 F |
| 2,062,772 | 12/1936 | Surface | 240/78 LD |
| 3,735,123 | 5/1973 | Porter et al. | 240/78 R X |
| D. 66,584 | 2/1925 | Rosenblatt | 240/78 R |

*Primary Examiner*—Edna M. O'Connor
*Attorney, Agent, or Firm*—Wolder & Gross

[57] ABSTRACT

A suspended electric light fixture includes a main body member and a suspension loop integrally cast of metal, the loop being delineated from the body member by a hub section having a threaded bore which is engaged by a depending threaded sleeve supporting a light socket and carrying the electric wire to the socket. The body member terminates at its bottom in a shade engaging ring.

5 Claims, 4 Drawing Figures

CASTING CONSTRUCTION

BACKGROUND OF THE INVENTION

The present invention relates generally to improvements in electric light fixtures and it relates more particularly to an improved electric light fixture of the suspension type.

The conventional suspension type light fixture generally includes a main body member which carries a shade or globe and is desirably decorative and supports a light bulb socket assembly. The body member is surmounted by a separate loop member which facilitates the suspension of the light fixture by a chain or other hanger means. The separate body and loop members are generally joined by an externally threaded leave which engages vertical coaxial bores of the same diameter in the body and loop member, the sleeve functioning as a wire conduit and usually extending to the light socket assembly. The conventional suspended light fixture assembly described above possesses numerous drawbacks and disadvantages. The cost of the fixture is unnecessarily higher by reason of the cost involved in producing separate castings of the loop and body members, the higher precision required to effect the proper mating of the parts with possible machining required of the cast parts, the production of a pair of tapped bores and the time consuming assembly of the separate parts. Furthermore, the assembled end product is frequently defective in that a proper assembly of the loop and body members is not achieved, these members are loose and not accurately aligned and the socket assembly is loosely supported and off center. It is thus clear from the above that the conventional metal cast suspended light fixture and its fabrication leave much to be desired.

SUMMARY OF THE INVENTION

It is accordingly a principal object of the present invention to provide an improved electric light fixture.

Another object of the present invention is to provide an improved suspension type electric light fixture.

Still another object of the present invention is to provide an improved electric light fixture of the suspension type provided at its top with a suspension chain or hanger engaging loop.

A further object of the present invention is to provide a device of the above nature characterized by its ruggedness, simplicity, reliability, low cost, attractive appearance, ease of fabrication and assembly and high versatility and adaptability.

The above and other objects of the present invention will become apparent from a reading of the following description taken in conjunction with the accompanying drawing which illustrates a preferred embodiment thereof.

In a sense the present invention contemplates the provision of an improved suspension or hanging type electric fixture comprising a hollow metal body member, a light bulb socket supported by said body member and a suspension loop member located atop and integrally formed with said body member.

In accordance with a preferred form of the present invention the body member includes a vertical hollow stem having a slight downward outward taper and joining at its bottom an outwardly downwardly flaring base terminating in a depending ring which is adapted to engage and support a lampshade or globe. The body member stem terminates at its top in an integrally formed hub having a tapped vertical axial bore with which is integrally formed the vertical loop which is of closed configuration. An externally threaded pipe engages the tapped bore and depends to the base of the fixture and supports at its bottom a light bulb socket.

The improved suspension type light fixture is simple and inexpensive to produce with great precision and reliability, is rugged and of uniform high quality, is of attractive appearance and great versatility and adaptability.

DESCRIPTION OF THE PREFERRED EMBODIMENT

Figure 1:
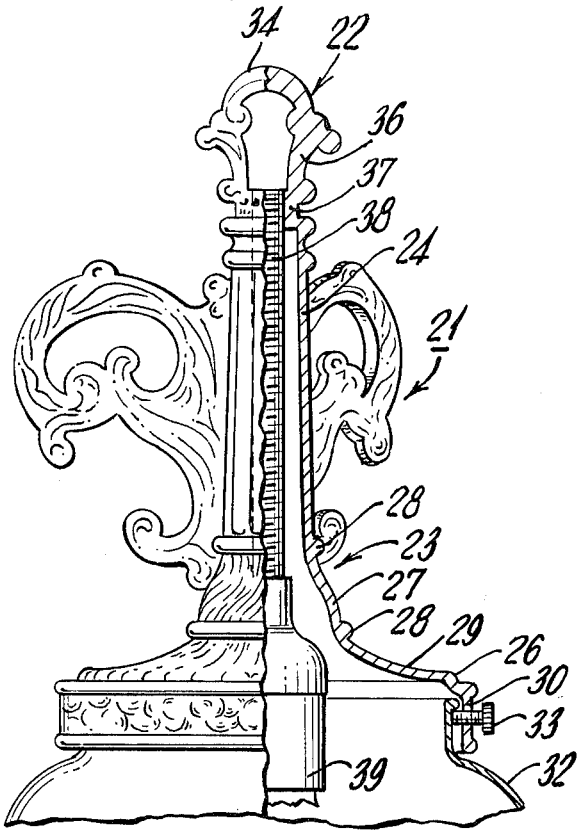
FIG. 1 is a front elevational view partially in section, of a lighting fixture embodying the present invention.
Figure 3:
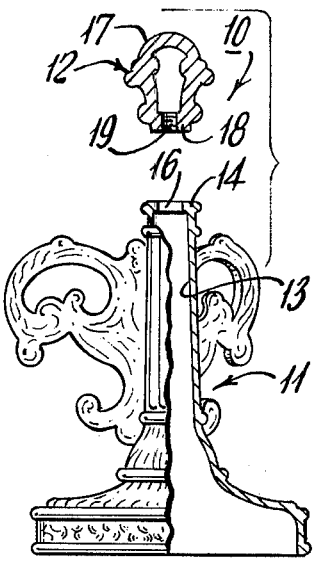
Fig. 3. (PRIOR ART)
FIG. 3 is an exploded front elevational view partially in section of a prior art lighting fixture.

Referring now to the drawing which illustrates a preferred embodiment of the present invention as well as an example of a suspension type lighting fixture corresponding to the improved lighting fixture, the reference numeral 10 generally designates the prior art lighting fixture which includes a main body member 11 and a suspension loop member 12 which is separate from the body member 11, body and loop members 11 and 12 being separately fabricated. The body member 11 includes a vertical hollow stem 13 closed by a top wall 14 having a central opening 16.

The loop member 12 includes an upper loop section 17 closed at its bottom by a hub section 18 having a tapped bore 17. In the assembled condition of lighting fixture 10, the hub section 18 is superimposed on top end wall 14 with bores 16 and 19 in axially alignment and the body and loop members are locked in assembled condition by an elongated externally threaded sleeve 20 traversing wall opening 16 and engaging hub bore 19, a nut 21 engaging the sleeve and tightly bearing on the underface of top end wall 14. The construction and fabrication of lighting fixture 10 possess numerous drawbacks and disadvantages as described.

Figure 2:
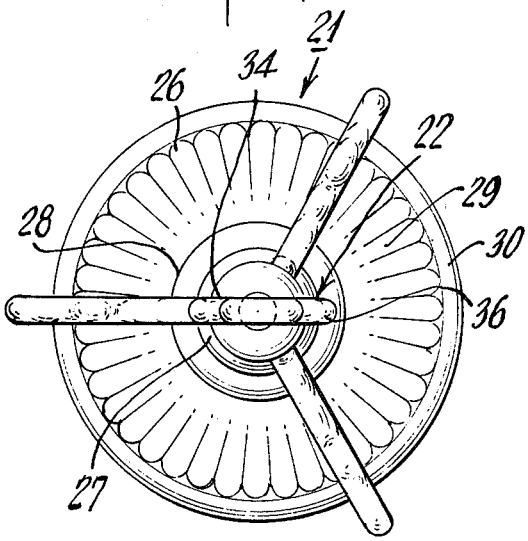
FIG. 2 is a top plan view thereof.
Figure 4:
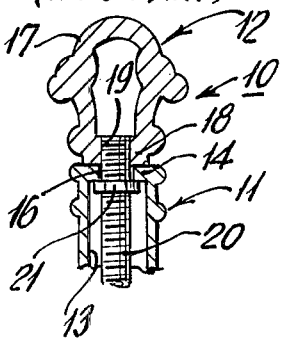
Fig. 4. (PRIOR ART)
FIG. 4 is an assembled fragmentary vertical medial sectional view thereof.

As seen in FIGS. 1 and 2, the improved lighting fixture generally designated by the reference numeral 21 is broadly characterized by the feature that the suspension loop 22 and the body member 23 of the lighting fixture 21 are an integrally formed unit. The light fixture unit 21 is cast or molded preferrably of any suitable conveniently or moldable metal alloy such as bronze, brass, or the like and is decorated and faced as desired.

The body member 23 includes a vertical tubular upper stem section 24 which is downwardly outwardly tapered and provided on its outer face with vertical flutes or ribs. The bottom of stem section 24 joins a base or bottom section 26 by way of a bell shaped intermediate section 27 which is downwardly outwardly tapered and delineated from the stem and base sections by upper and lower peripheral ribs 28.

The base section 26 includes a downward outwardly flared curved top wall 29 which extends from lower rib 28 and terminates in a depending coaxial cylindrical ring 30 which may be constructed to releasably engage, couple and support any suitable depending lampshade or globe 32. To this end a circumferentially spaced plurality of tapped radial bores are formed in the ring 30 and are engaged by thumb screws 33 whose inner ends engage a peripheral groove in the upper neck of shade or globe 32.

The suspension loop member 22 is shown as of highly decorative configuration and includes an arcuate upwardly convex upper cross piece 34 from which depend similar side legs 36. The legs 36 are joined at their bottom by a vertical cylindrical hub section 37 closing the top of stem section 24 and having formed therein a tapped axial bore. It is important that the loop and body member 22 and 23 including the hub 37 be an integrally formed unit according to the present invention.

An elongated externally threaded pipe or tube 38 engages at its upper end the tapped bore in hub section 37 and depends therefrom coaxially with and below stem section 24. The lower end of pipe 38 is engaged by and supports an electric light socket 39 of conventional construction. A chain or other hanger or suspension member engages the loop member 22 to desirably suspend the improved light fixture 21 and an electric power line extends along the hanger and through pipe 38 to socket member 39 to which it is connected in the known manner.

The loop and body members 22 and 23 may be shaped and decorated, as desired, and provided with any desired accessories and decorative features. Moreover, while the loop member 22 is illustrated as a closed loop it may be an open loop, hook shaped or the like.

While there has been described and illustrated a preferred embodiment of the present invention, it is apparent that numerous alterations, omissions and additions may be made without departing from the spirit thereof.

I claim:

1. A suspension type electric light fixture comprising a vertically axially extending hollow open bottomed body member including an upper vertical elongated tubular stem section terminating at its top in an integrally formed coaxial vertical hub section having a threaded vertical axial bore extending for the full length thereof, a light bulb socket, means supporting said light bulb socket from said hub and including an externally threaded pipe engaging said threaded bore and depending therefrom coaxially with said stem section and supporting said light socket at its lower end, and a suspension loop member located atop and projecting upwardly from and integrally formed with said hub section.

2. The electric light fixture of claim 1 wherein said body member comprises a radially enlarged lower hollow base section joined to the lower end of said stem section.

3. The electric light fixture of claim 2 wherein said base section includes a bottom cylindrical ring portion and means for coupling a lamp shade to said ring portion.

4. The electric light fixture of claim 3 wherein said ring portion has circumferentially tapped radial bores therein and said coupling means comprises thumb screws engaging said circumferentially spaced tapped bores.

5. The electric light fixture of claim 1 wherein said loop member comprises a top cross piece and side legs depending from said cross piece and joined at their bottoms to the side of said hub section.

* * * * *